US009528527B2

(12) United States Patent
Sekularac et al.

(10) Patent No.: US 9,528,527 B2
(45) Date of Patent: Dec. 27, 2016

(54) COMPRESSOR OF AN EXHAUST-GAS TURBOCHARGER

(75) Inventors: Aleksandar Sekularac, Worms (DE); Thomas Lischer, Neustadt (DE)

(73) Assignee: BorgWarner Inc., Auburn Hills, MI (US)

( * ) Notice: Subject to any disclaimer, the term of this patent is extended or adjusted under 35 U.S.C. 154(b) by 516 days.

(21) Appl. No.: 14/115,497

(22) PCT Filed: Apr. 26, 2012

(86) PCT No.: PCT/US2012/035156

§ 371 (c)(1),
(2), (4) Date: Nov. 4, 2013

(87) PCT Pub. No.: WO2012/154414

PCT Pub. Date: Nov. 15, 2012

(65) Prior Publication Data

US 2014/0093354 A1 Apr. 3, 2014

(30) Foreign Application Priority Data

May 10, 2011 (DE) ..... 10 2011 101 036

(51) Int. Cl.

| | |
|---|---|
| ***F04D 27/02*** | (2006.01) |
| ***F04D 29/42*** | (2006.01) |
| ***F04D 17/10*** | (2006.01) |
| ***F04D 29/68*** | (2006.01) |
| *F02B 37/16* | (2006.01) |

(52) U.S. Cl.

CPC ..... *F04D 27/0238* (2013.01); *F04D 17/10* (2013.01); *F04D 27/0215* (2013.01); *F04D 27/0246* (2013.01); *F04D 29/4213* (2013.01); *F04D 29/685* (2013.01); *F02B 37/16* (2013.01)

(58) Field of Classification Search

CPC .. F04D 17/10; F04D 27/0215; F04D 27/0238; F04D 27/0246; F04D 27/0207; F04D 27/023; F04D 27/009; F04D 29/4206; F04D 29/4213; F04D 29/462; F04D 29/685; F02B 37/16; F02B 37/22

USPC ..... 415/58.2, 58.3, 58.4, 58.6; 60/605.1

See application file for complete search history.

(56) References Cited

U.S. PATENT DOCUMENTS

| | | | | |
|---|---|---|---|---|
| 4,930,979 A | | 6/1990 | Fisher | |
| 5,863,178 A | * | 1/1999 | Scheinert | F01D 25/30 415/58.4 |

(Continued)

FOREIGN PATENT DOCUMENTS

| | | |
|---|---|---|
| JP | 2011-085095 A | 4/2011 |
| WO | 2007-098133 A1 | 8/2007 |

*Primary Examiner* — Craig Kim
*Assistant Examiner* — Juan G Flores
(74) *Attorney, Agent, or Firm* — A. Michael Tucker; Stephan A. Pendorf; Patent Central LLC

(57) ABSTRACT

A compressor (1) of an exhaust-gas turbocharger (ATL), having a compressor wheel (2) and a compressor housing (3) which has a housing longitudinal axis (A). The compressor wheel (2) is arranged in the housing. An inlet duct (5) runs from a compressor inlet (4) to the compressor wheel (2). A recirculation duct (6) has a compressor-wheel-side inflow opening (7) and a compressor-inlet-side return flow opening (8). The inflow opening (7) and the return flow opening (8) can be opened and closed.

11 Claims, 2 Drawing Sheets

(56) References Cited

U.S. PATENT DOCUMENTS

Figure 1:
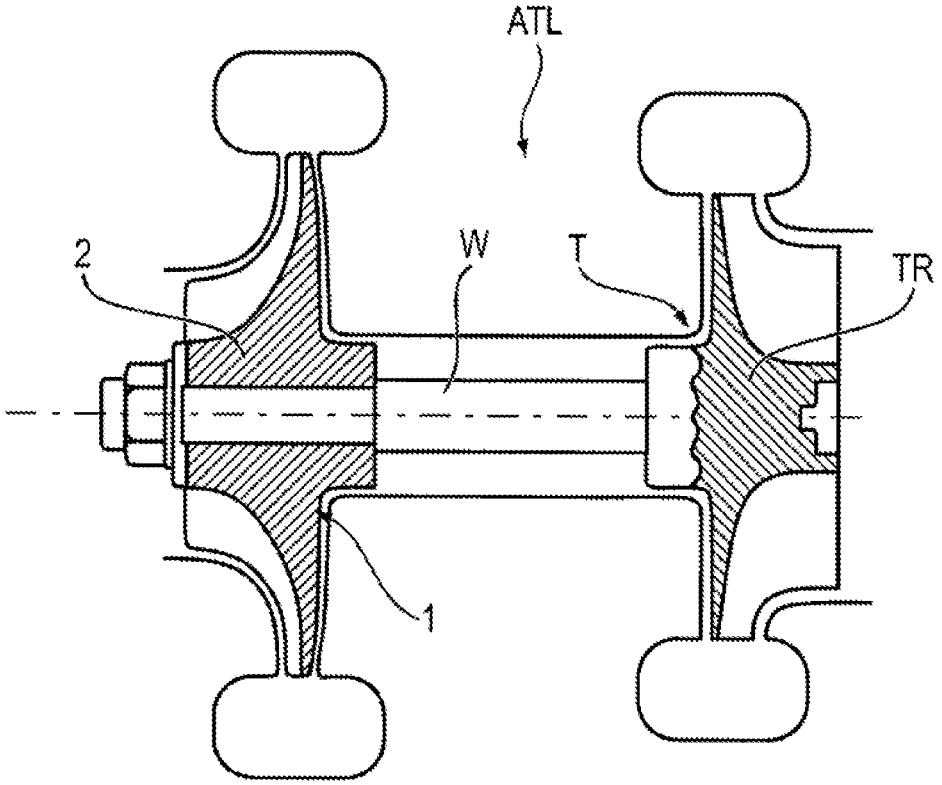

| | | | | |
|---|---|---|---|---|
| 6,634,174 | B2 * | 10/2003 | Sumser | F02B 37/225 60/602 |
| 8,061,974 | B2 * | 11/2011 | Gu | F04D 27/0207 415/145 |
| 2009/0060708 | A1 * | 3/2009 | Hale | F02C 1/005 415/58.2 |
| 2010/0260595 | A1 | 10/2010 | Gottemoller et al. | |
| 2012/0121400 | A1 | 5/2012 | Tomita et al. | |

* cited by examiner

COMPRESSOR OF AN EXHAUST-GAS TURBOCHARGER

The invention relates to a compressor of an exhaust-gas turbocharger as per the preamble of claim 1.

A compressor of said type is known from DE 10 2009 019 754 A1.

The bypass or recirculation duct provided therein, commonly referred to as a so-called "characteristic-map-stabilizing measure", has the effect that the compressor characteristic map can be extended in the region of the surge limit. The provision of such a recirculation duct and of the passage in the region of the wheel contour however lead to a degradation in efficiency in wide ranges of the characteristic map, even though the characteristic-map-stabilizing measures are not active here.

It is therefore an object of the present invention to create a compressor of the type specified in the preamble of claim 1, which compressor makes it possible to provide a characteristic-map-stabilizing measure without efficiency disadvantages in relation to a compressor without such characteristic-map-stabilizing measures.

Said object is achieved by means of the features of claim 1.

By virtue of the fact that the inflow and return flow openings of the recirculation duct can be opened and closed, said duct can be activated only in those characteristic map regions in which it also active in terms of the surge limit. The duct can be deactivated in the region of part load or full load of the engine, such that the efficiency of the compressor according to the invention can be improved overall.

Although EP 1 639 245 B1 discloses a compressor which likewise has an additional duct adjacent to the compressor inlet duct, said additional duct cannot serve as a recirculation duct because its inlet side is always flow-connected to an air collecting chamber even when its outlet side is closed by means of a shut-off element. Furthermore, in said blocking position, the entire inlet duct to the compressor wheel is closed by the shut-off element, whereas the inlet duct of the compressor according to the invention remains open even when the recirculation duct is closed.

The subclaims relate to advantageous refinements of the invention.

Figure 2:
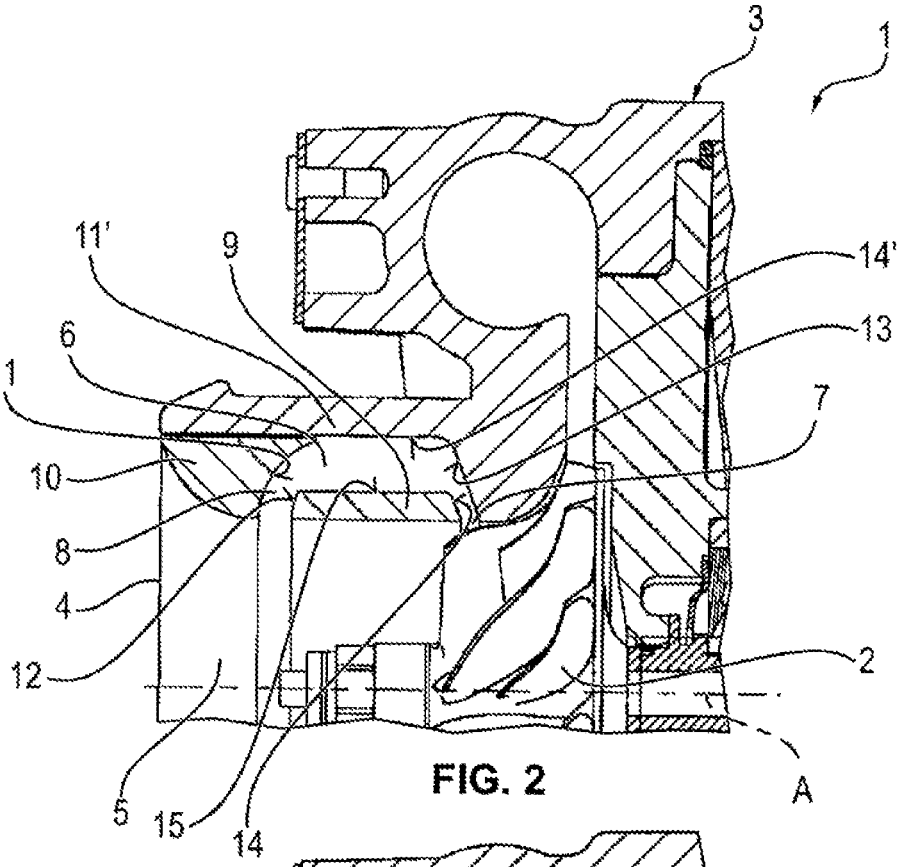
Figure 3:
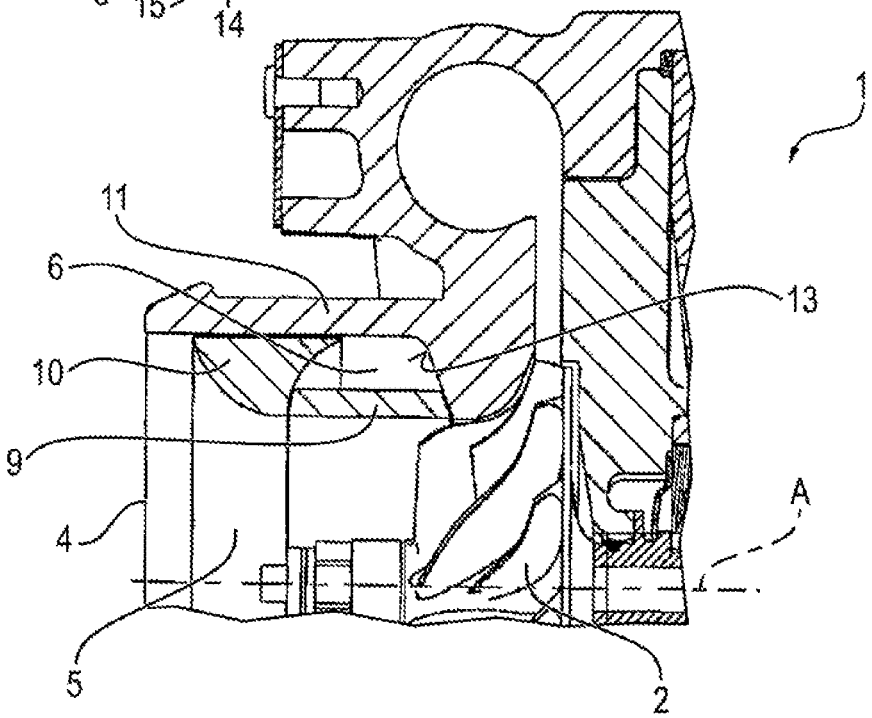

Further details, advantages and features of the present invention will emerge from the following description of an exemplary embodiment on the basis of the drawing, in which:

FIG. 1 shows a schematically highly simplified diagrammatic illustration of an exhaust-gas turbocharger which may be provided with a compressor according to the invention, FIG. 2 shows a partial section through a compressor according to the invention, with the recirculation duct open, and FIG. 3 shows an illustration of the compressor corresponding to FIG. 2, with the recirculation duct closed.

FIG. 1 shows an exhaust-gas turbocharger ATL in a diagrammatically highly simplified illustration, which exhaust-gas turbocharger has, as is conventional, a turbine T whose turbine wheel TR is connected via a shaft W to a compressor wheel 2 of the compressor 1 according to the invention. The exhaust-gas turbocharger self-evidently also has all the other conventional components, the description of which is however not necessary for explaining the principles of the present application.

FIGS. 2 and 3 show a sectional illustration through that region of the compressor 1 which is arranged above a longitudinal axis A. The compressor 1 has a compressor wheel 2 which is arranged in a compressor housing 3.

The compressor housing 3 has a compressor inlet 4 from which an inlet duct 5 leads to the compressor wheel 2. Here, the compressor longitudinal axis A also forms the longitudinal axis of said inlet duct 5.

As shown by FIGS. 2 and 3, the inlet duct 5 has a recirculation duct 6 preferably arranged parallel thereto. The recirculation duct 6 has a compressor-wheel-side inflow opening 7 and an inlet-side return flow opening 8.

In the particularly preferred embodiments of FIGS. 2 and 3, to make it possible for the inflow opening 7 and the return flow opening 8 to be opened and closed, an axially movable sleeve 9 and an axially movable slide 10 are provided, wherein the respective movement of the sleeve 9 and of the slide 10 takes place in the direction of the longitudinal axis A.

In the embodiment illustrated in FIGS. 2 and 3, the recirculation duct 6 is delimited by an inner wall surface 14', which runs parallel to the longitudinal axis A, of a housing region 11' of the compressor housing 3, by a return flow surface 11 of the slide 10, by an inflow surface 13 of the housing region 11', and by a flow surface 15 of the sleeve 9.

As shown in FIG. 1, the return flow surface 11 is of rounded design in order to improve its flow characteristics. Accordingly, in the region of the return flow opening 8, the sleeve 9 has a likewise rounded return flow surface 12, the rounding of which corresponds to that of the return flow surface 11.

The inflow surface 13 of the housing region 11' is formed so as to be inclined relative to the longitudinal axis A, as shown in FIGS. 2 and 3. The sleeve 9 has, in the region of the inflow opening 7, a likewise inclined inflow surface 14, the inclination of which corresponds to the inclination of the inflow surface 13. These measures, too, serve to improve the flow characteristics of the inflow opening 7.

FIG. 2 shows the open position of the inflow opening 7 and of the return flow opening 8, in which the recirculation duct 6 is consequently activated in order to permit a return flow of intake air flowing to the compressor wheel 2, which serves to extend the characteristic map of the compressor or exhaust-gas turbocharger by shifting the surge limit.

In other characteristic map regions in which the recirculation duct 6 is not active in any case, said recirculation duct is closed by moving the slide 10 and the sleeve 9, as illustrated in FIG. 3. For this purpose, the slide 10 and if appropriate the sleeve 9 may in each case be connected to an actuator. The actuator for the sleeve 9 may for example be a spring (not illustrated) which preloads the sleeve 9 into the open position as per FIG. 2.

To supplement the above written disclosure of the invention, reference is hereby explicitly made to the diagrammatic illustration thereof in FIGS. 1 to 3.

LIST OF REFERENCE SYMBOLS

1 Compressor
2 Compressor wheel
3 Compressor housing
4 Compressor inlet
5 Inlet duct
6 Recirculation duct
7 Inflow opening
8 Return flow opening
9 Sleeve
10 Slide
11 First return flow surface

11' Housing region
12 Second return flow surface
13 First inflow surface
14 Second inflow surface
14' Inner surface
15 Flow surface
ATL Exhaust-gas turbocharger
T Turbine
TR Turbine wheel
W Shaft
A Longitudinal axis of the compressor housing 3, of the inlet duct 5 and of the recirculation duct 6

The invention claimed is:

1. A compressor (1) of an exhaust-gas turbocharger (ATL), having
- a compressor wheel (2); and
- a compressor housing (3)
  - which has a housing longitudinal axis (A),
  - in which the compressor wheel (2) is arranged,
  - which has an inlet duct (5), said inlet duct running from a compressor inlet (4) to the compressor wheel (2) and having a hooded ported shroud recirculation duct (6) which has a compressor-wheel-side inflow opening (7) and a compressor-inlet-side return flow opening (8), and
  - means for opening and closing the return flow opening (8) while leaving the inflow opening (7) open,
- wherein the recirculation duct (6) is delimited by an inner surface (14') of an adjacent housing region (11') of the compressor housing (3), an axially moveable sleeve (9) and an axially moveable slide (10) upstream of the axially moveable sleeve (9), and
- wherein said return flow opening (8) is opened and closed by moving the axially moveable sleeve (9) relative to the slide (10) or by moving the axially moveable slide (10) relative to the sleeve (9).

2. A compressor (1) of an exhaust-gas turbocharger (ATL), having
- a compressor wheel (2); and
- a compressor housing (3)
  - which has a housing longitudinal axis (A),
  - in which the compressor wheel (2) is arranged,
  - which has an inlet duct (5), said inlet duct running from a compressor inlet (4) to the compressor wheel (2) and having a hooded ported shroud recirculation duct (6) which has a compressor-wheel-side inflow opening (7) and a compressor-inlet-side return flow opening (8), and
  - means for opening and closing at least one of the inflow opening (7) and the return flow opening (8),
- wherein the recirculation duct (6) is delimited by an axially moveable sleeve (9), an axially moveable slide (10) upstream of the axially moveable sleeve (9) and an inner surface (14') of an adjacent housing region (11') of the compressor housing (3).

3. The compressor as claimed in claim 2, wherein the slide (10) has a rounded first return flow surface (11) which leads to the return flow opening (8).

4. The compressor as claimed in claim 3, wherein the sleeve (9) has a rounded second return flow surface (12).

5. The compressor as claimed in claim 2, wherein the housing region (11') has a first inflow surface (13) which is inclined relative to the longitudinal axis (A) and which leads to the inflow opening (7).

6. The compressor as claimed in claim 5, wherein the sleeve (9) has a second inflow surface (14), the inclination of which corresponds to the inclination of the first inflow surface (13).

7. The compressor as claimed in claim 2, wherein the slide (10) can be actuated by means of an actuator.

8. The compressor as claimed in claim 2, wherein the sleeve (9) can be actuated by means of an actuator.

9. The compressor as claimed in claim 2, wherein the recirculation duct (6) runs parallel to the inflow duct (5).

10. The compressor as claimed in claim 2, wherein the axially movable slide (10) is the hood of the hooded ported shroud when in the open position.

11. A compressor (1) of an exhaust-gas turbocharger (ATL), having
- a compressor wheel (2); and
- a compressor housing (3)
  - which has a housing longitudinal axis (A),
  - in which the compressor wheel (2) is arranged,
  - which has an inlet duct (5), said inlet duct running from a compressor inlet (4) to the compressor wheel (2) and having a hooded ported shroud recirculation duct (6) which has a compressor-wheel-side inflow opening (7) and a compressor-inlet-side return flow opening (8), and
  - means for opening and closing at least one of the inflow opening (7) and the return flow opening (8),
- wherein the recirculation duct (6) is delimited by an inner surface (14') of an adjacent housing region (11') of the compressor housing (3), an axially moveable sleeve (9) and an axially moveable slide (10) upstream of the axially moveable sleeve (9), and
- wherein the slide (10) can be actuated by means of an actuator, the sleeve (9) can be actuated by means of an actuator, and wherein both the inflow opening (7) and the return flow opening (8) can be closed at the same time by actuation of both the slide (10) and the sleeve (9).

* * * * *